United States Patent [19]

Taguchi

[11] Patent Number: 4,620,685

[45] Date of Patent: Nov. 4, 1986

[54] ROTATING MECHANISM ATTACHABLE TO BOTTOM OF CONTAINER

[75] Inventor: Haruyoshi Taguchi, Osaka, Japan

[73] Assignee: Suntory Limited, Osaka, Japan

[21] Appl. No.: 631,719

[22] Filed: Jul. 17, 1984

[30] Foreign Application Priority Data

| | | | |
|---|---|---|---|
| Nov. 11, 1983 | [JP] | Japan | 58-174433[U] |
| Nov. 15, 1983 | [JP] | Japan | 58-176087[U] |
| Nov. 22, 1983 | [JP] | Japan | 58-180625[U] |
| Dec. 1, 1983 | [JP] | Japan | 58-186066[U] |
| Jan. 20, 1984 | [JP] | Japan | 59-5344[U] |

[51] Int. Cl.[4] ..... A47B 91/00

[52] U.S. Cl. ..... 248/349; 220/69; 248/359

[58] Field of Search ..... 248/359 E, 359 R, 346, 248/346.1, 349, 131; 220/68, 69; 215/100.5

[56] References Cited

U.S. PATENT DOCUMENTS

| | | | |
|---|---|---|---|
| 3,170,738 | 2/1965 | Winfree | 248/349 X |
| 3,524,614 | 8/1970 | Sorth | 248/131 |
| 4,489,846 | 12/1984 | Nickel | 220/69 |

FOREIGN PATENT DOCUMENTS

| | | | |
|---|---|---|---|
| 566125 | 9/1933 | Fed. Rep. of Germany | 215/100.5 |
| 845927 | 8/1952 | Fed. Rep. of Germany | 248/349 |
| 2449364 | 4/1976 | Fed. Rep. of Germany | 248/349 |
| 1231388 | 5/1971 | United Kingdom . | |
| 1336340 | 11/1973 | United Kingdom . | |

*Primary Examiner*—J. Franklin Foss
*Assistant Examiner*—David L. Talbott
*Attorney, Agent, or Firm*—Burns, Doane, Swecker & Mathis

[57] ABSTRACT

A rotating mechanism attachable to the bottom of a container comprising:

(A) a base member composed of (i) a circular side wall provided with means for preventing the base member from becoming detached from an attachment member and (ii) a base plate provided at the bottom portion of the circular side wall; and (B) the attachment members composed of (i) a peripheral support portion having an outer diameter smaller than an inner diameter of the circular side wall and (ii) an attachment plate, the bottom portion of the circular side wall of the base member being connected to the peripheral support portion at connecting portions thereof in such a manner that both portions are readily mechanically separable from each others.

5 Claims, 27 Drawing Figures

ROTATING MECHANISM ATTACHABLE TO BOTTOM OF CONTAINER

BACKGROUND OF THE INVENTION

1. Field of the Invention

The present invention relates to a rotating mechanism attachable to the bottom of a container. More specifically, it relates to a simple rotating mechanism suitable for attaching to, for example, the bottom of a middle-sized beer container with a handle, thereby readily rotating the container.

2. Description of the Prior Art

Recently, beer, especially draft beer, has been widely marketed in various middle-sized containers or bottles having, for example, a 2 to 3 liter capacity. At first, these containers were designed so that beer was poured into a jug or glass by holding the containers with both hands. In a step further, a handle was attached to the container to facilitate the pouring. However, this type of the container still causes inconvenience when the handle is facing away from a person attempting to grasp the handle. That is, to grasp the handle the container must first be rotated, i.e., placed in a proper position, with both hands, or the side of the container must be pushed into position with one hand; causing no little inconvenience to the person wishing to pour beer from the container.

It is known that containers with a handle such as Thermos type vacuum bottles, can be rotated. Thermos type bottles have a structure such that a rotating mechanism is freely and rotatably attached to the bottom of the body of the Thermos type bottle. Thermos type bottles are designed so that the rotating mechanisms are tough and will rotate smoothly for a long period, since these type bottles must have a long lifetime. For this reason, special rotating mechanisms produced at a reasonable cost are acceptable for use with thermos type bottles.

Contrary to the above, however, rotating mechanisms to be attached to, for example, middle-sized beer containers, should be less expensive to produce, since the containers are not expected to be in use for a long time. Thus, known rotating mechanisms used, for example, at the bottom of Thermos type bottles cannot be used for the middle-sized beer containers, although the performance of those rotating mechanisms has many of the desired advantages. That is, when those rotating mechanisms are applied to the middle-sized beer containers, disadvantages arise in that the manufacture of the rotating mechanism and the attachment thereof to the bottom of the body of the beer containers would be troublesome and costly. Accordingly, there is a demand for the development of a container provided with a handle capable of being rotated by a rotating mechanism which has a simple structure and can be readily manufactured at a low cost.

Under the above-mentioned circumstances, the present inventors devised several rotating devices capable of smoothly rotating containers for a short period when fitted to the bottom of those containers, and also capable of being readily manufactured and attached at a relatively low cost. These rotating devices are disclosed in Japanese Patent Application No. 58-43066 and Japanese Utility Model Application Nos. 58-37509, 58-49619, and 58-49620.

However, although these rotating devices all utilize a rotating table, which is fitted to the bottom member of the plastic beer container, they are still unsatisfactory from the viewpoint of production costs. Accordingly, the inventors devised further, as disclosed in Japanese Patent Application Nos. 58-143579 and 58-149037, a beer container comprising a film-like disc attached to the lower end of the plastic container to be freely and rotatably in contact with the bottom of the plastic container.

However, there still remains a problem in that the bottom of these plastic containers must be modified by, for example, forming center projections, or fitting grooves.

SUMMARY OF THE INVENTION

Accordingly, the objects of the present inventions are to eliminate the above-mentioned disadvantages or problems of the prior art and to provide a rotating mechanism capable of being attached to the bottom of a container without modifying the container, and also capable of being molded in an integral form.

Another object of the present invention is to provide a rotating mechanism capable of being readily attached to the bottom of a container without the risk of the mechanism becoming separated from the container.

Other objects and advantages of the present invention will be apparent from the following description.

In accordance with the present invention, there is provided a rotating mechanism attachable to the bottom of a container comprising:

(A) a base member composed of (i) a circular side wall provided with means for preventing the separation of the base member from an attachment member after the attachment thereof to the bottom of a container; and (ii) a base plate provided at the bottom portion of the circular side wall; and (B) the attachment member composed of (i) a peripheral support portion having an outer diameter smaller than an inner diameter of the circular side wall and (ii) an attachment plate, the bottom portion of the circular side wall of the base member being connected to the peripheral support portion at connecting portions thereof in such a manner that both portions are readily mechanically separable from each other.

BRIEF DESCRIPTION OF THE DRAWINGS

The present invention will now be described in detail with reference to, but by no means limited to, the accompanying drawings in which.

DESCRIPTION OF THE PREFERRED EMBODIMENTS

The rotating mechanism of the present invention is designed so that it can be molded by using one mold in an integral form or can be shaped by a one-time process from a resin such as, for example, polyethylene or polypropylene.

The rotating mechanism of the present invention generally comprises a base member and an attachment member which are integrally formed or molded. Thus, the base member is connected to the attachment member at connecting or contacting portions in such a manner that both members can be readily mechanically separable from each other. Such a connection can be readily carried out by any conventional molding technique and the separation thereof can be manually effected by a method well-known in the art.

The base member has the following functions. That is, the base plate of the base member is placed on, for example, the surface of a table and the container is placed on the top of the circular side wall. Thus, the container can be freely rotated by sliding the bottom surface of the container on the top surface of the circular side wall. At the same time, the center of the rotation is provided by freely rotating the periphery of the attachment member in the inside of the circular side wall.

The attachment member is attached at the attachment portion thereof to the bottom portion of the container. Then, the attachment member functions as a means for providing the center of the rotation of the container by freely rotating within the circular side wall of the base member, as mentioned above. The attachment of the attachment member to the bottom of the container can be effected by using any conventional technique, for example, adhesives.

According to the present invention, various devices or means for preventing the base member from becoming detached from the attachment member after the attachment member is separated from the base member by breaking the connecting portions are provided. It should be noted that these separation preventing means must be designed so that the molded rotating mechanism can be removed from the mold. These devices are explained in detail hereinbelow in each embodiment of the present invention with reference to the accompanying drawings.

Figure 1A:
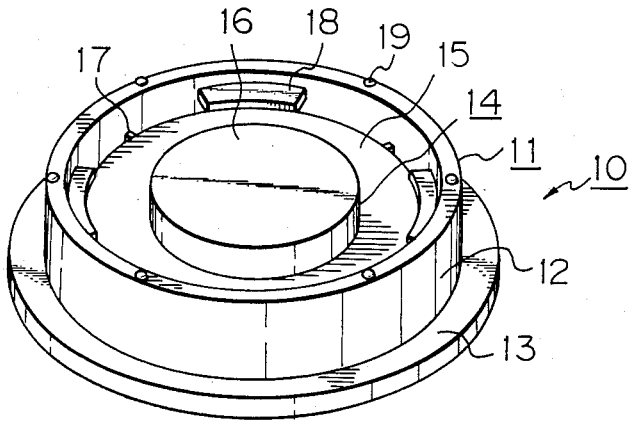
FIG. 1A is a perspective view of a first embodiment of the rotating mechanism according to the present invention.
Figure 1B:
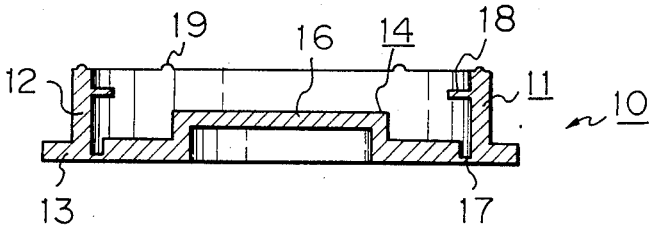
FIG. 1B is a sectional view of the rotating mechanism of FIG. 1A before attachment.
Figure 1C:
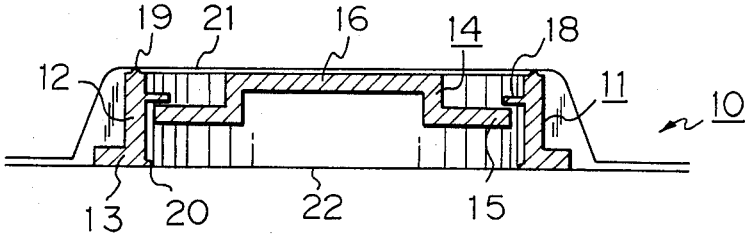
FIG. 1C is a sectional view of the rotating mechanism of FIG. 1A after attachment.

The first preferred embodiment of the rotating mechanism according to the present invention is shown in FIGS. 1A, 1B, and 1C.

As is clear from these drawings, a rotating mechanism 10 comprises a base member 11 and an attachment member 14. These members are molded from the same material in one operation and are connected to each other at connecting portions 17. The base member 11 is composed of a circular side wall 12 and a base plate 13. The attachment member 14 is composed of a peripheral support portion 15 and an attachment plate 16. The outer diameter of the peripheral support portion 15 must be smaller than an inner diameter of the circular side wall 12.

According to this embodiment of the present invention, fixed stoppers 18 are mounted on the inside wall of the circular side wall 12 for preventing the base member 11 from becoming detached from the attachment member 14 after the base member 11 is separated from the attachment member 14 by breaking the connecting portions 17. For this reason, the stoppers 18 must be inwardly projected to such an extent that the base member 11 is not detached from the attachment member 14 after the attachment member 14 is attached to the bottom of the container. However, the sizes (e.g., length, width, and thickness) of the stoppers 18 must be such that the elasticity of the stoppers 18 enables the integrally molded rotating mechanism to be readily removed from a mold. These sizes of the stoppers 18 can be readily designed by those skilled in the art.

Although there is no special limitation to the number of the stoppers 18, a plurality of the stoppers 18 must be provided, preferably 3 or more.

Furthermore, according to the present invention, plural projections, preferably 3 or more of the projections 19 are provided on the top end surface of the circular side wall 12, to facilitate the sliding action of the bottom of the container when the container is rotated.

Figure 5A:
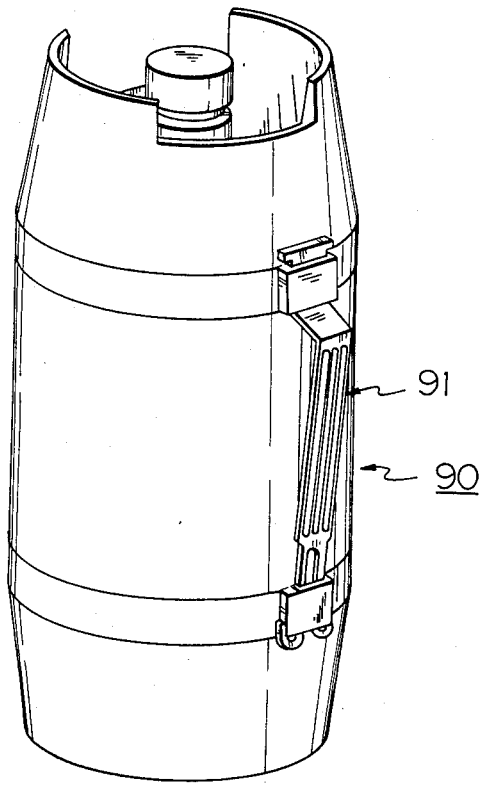
FIG. 5A is a perspective view of an example of a container to which the rotating mechanism according to the present invention is attached.
Figure 5B:
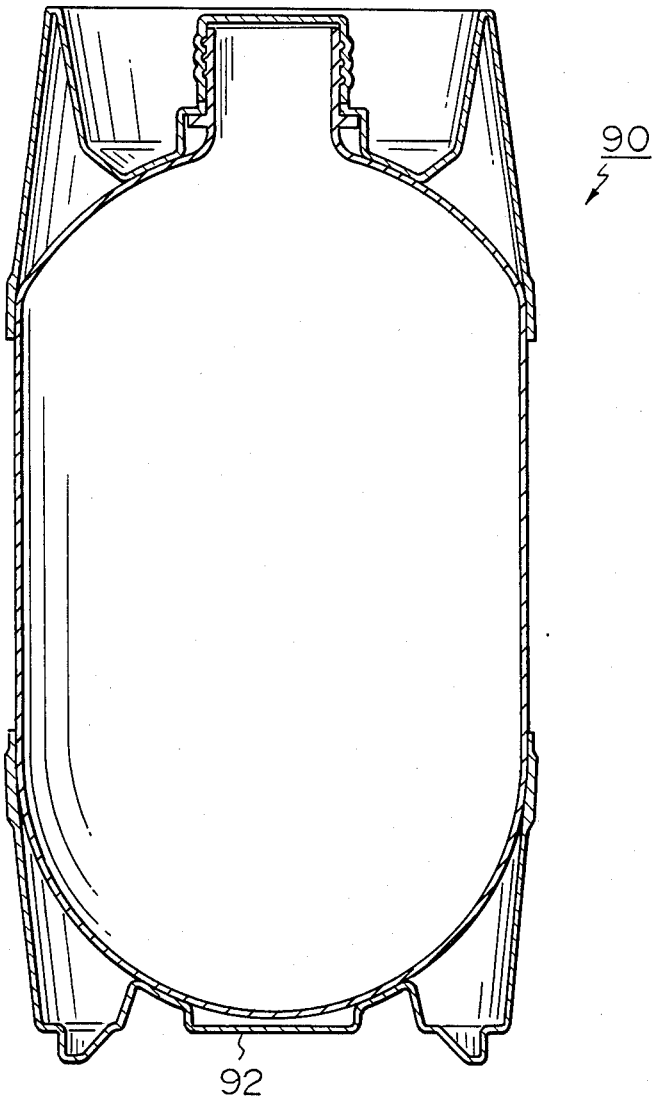
FIG. 5B is a sectional view of the container of FIG. 5A.

The rotating mechanism 10 of the present invention is advantageously attached to, for example, the bottom 92 (see FIG. 5B) of a beer container 90 as shown in FIGS. 5A and 5B. When the rotating mechanism is attached to the bottom 92 of the containers 90, the container 90 can be freely rotated so that a handle 91 can be readily grasped.

The rotating mechanism 10 of the present invention is attached to the bottom of the container 21 as shown in FIG. 1C. The attachment plate 16 is attached or bonded to the bottom of the container by means of, for example, a hot melt using any conventional adhesive. The separation of the attachment member 14 from the base member 11 can be readily effected manually either before or after the attachment of the rotating mechanism to the bottom of the container. Thus, the base member 11 is placed on, for example, the surface of a table 22 and the container can be readily and freely rotated with very little force. In FIG. 1C, a reference numeral 20 represents a point where the base member 11 and the attachment member 14 are connected before the separation thereof.

Figure 2A:
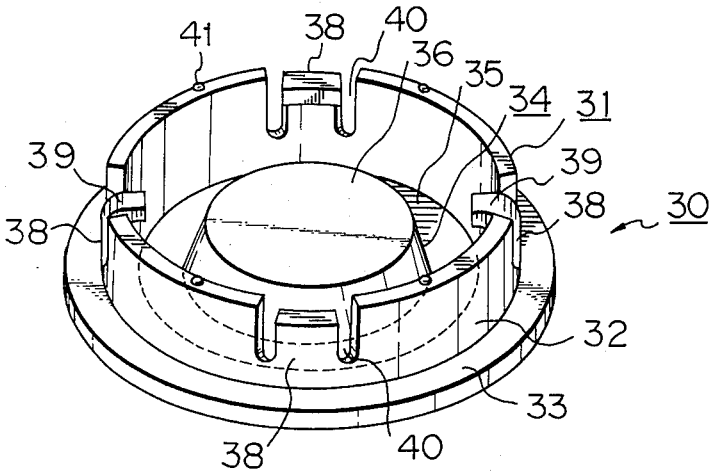
FIG. 2A is a perspective view of a second embodiment of the rotating mechanism according to the present invention.
Figure 2B:
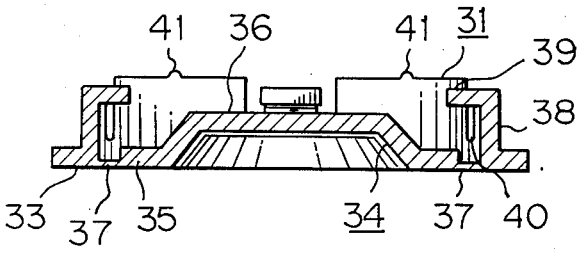
FIG. 2B is a sectional view of the rotating mechanism of FIG. 2A before attachment.
Figure 2C:
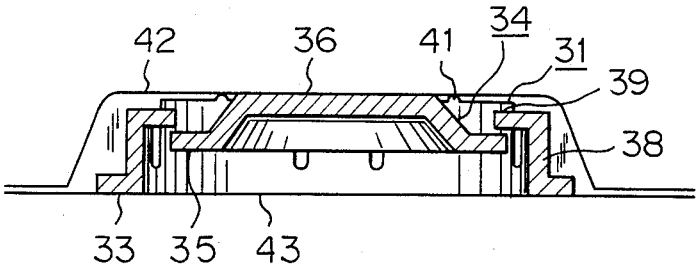
FIG. 2C is a sectional view of the rotating mechanism of FIG. 2A after attachment.

The second preferred embodiment of the rotating mechanism according to the present invention is shown in FIGS. 2A, 2B, and 2C.

As is clear from these drawings, a rotating mechanism 30 comprises a base member 31 and an attachment member 34. These members are molded from the same material in one operation and are connected to each other at connecting portions 37. The base member 31 is composed of a circular side wall 32 and a base plate 33. The attachment member 34 is composed of a peripheral support portion 35 and an attachment plate 36. The outer diameter of the peripheral support portion 35 must be smaller than an inner diameter of the circular side wall 32.

According to this embodiment of the present invention, fixed stoppers 38 in the form of a hook are formed at plural portions of the circular side wall 32. These stoppers prevent the base member 31 from becoming detached from the attachment member 34 when the base member 31 is separated from the attachment member 34 by breaking the connecting portions 37. For this reason, the top edge portion 39 of the stoppers 38 must be inwardly projected to such an extent that the base member 31 is not detached from the attachment member 34 after the attachment member 34 is attached to the bottom of the container. However, the structure and the size of the stoppers 38 should be such that the elasticity of the stoppers 38 enables the integrally molded rotating mechanism to be readily removed from a mold after the molding. For this reason, the stoppers 38 are substantially isolated from the body of the circular side wall 32 by slits 40. The size of the stoppers 38 can be readily designed by those skilled in the art.

Although there is no special limitation to the number of the stoppers 38, a plurality of the stoppers 38 must be provided, preferably 3 or more.

Furthermore, according to the present invention, plural projections, preferably 3 or more of the projections 41, are provided on the top end surface of the circular side wall 32 to facilitate the sliding action of the bottom of the container when the container is rotated.

The rotating mechanism 30 of the present invention is advantageously attached to, for example, the bottom 92 (see FIG. 5B) of a beer container 90, as shown in FIGS. 5A and 5B. When the rotating mechanism is attached to the bottom 92 of the container 90, the container 90 can be freely rotated so that a handle 91 can be readily grasped.

The rotating mechanism 30 of the present invention is attached to the bottom of the container 42 as shown in FIG. 2C. The attachment plate 36 is attached or bonded to the bottom of the container by means of, for example, a hot melt using any conventional adhesive. The separation of the attachment member 34 from the base member 31 can be readily effected manually either before or after the attachment of the rotating mechanism to the bottom of the container. Thus, the base member 31 is placed on, for example, the surface of a table 43 and the container can be readily and freely rotated with very little force.

The third preferred embodiment of the rotating mechanism according to the present invention is shown in FIGS. 3A to 3E.

As is clear from these drawings, a rotating mechanism 50 comprises a base member 51 and an attachment member 53. These members are molded from the same material in one operation and are connected to each other at connecting portions 56. The base member 51 is composed of a circular side wall 52 and a base plate 63. The attachment member 53 is composed of a peripheral support portion 54 and an attachment plate 55. The outer diameter of the peripheral support portion 54 must be smaller than an inner diameter of the circular side wall 52.

Figure 3A:
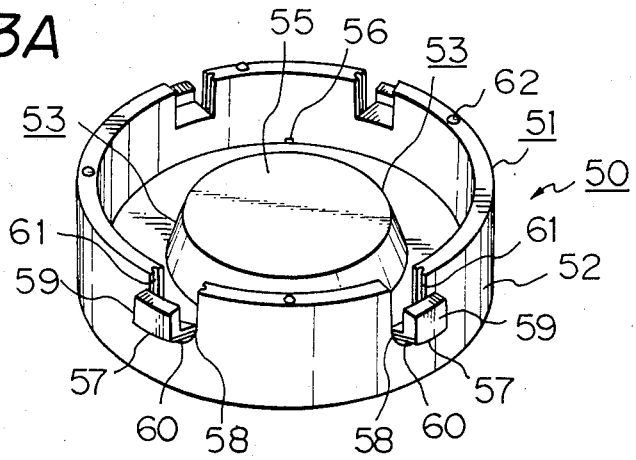
FIG. 3A is a perspective view of a third embodiment of the rotating mechanism according to the present invention.
Figure 3B:
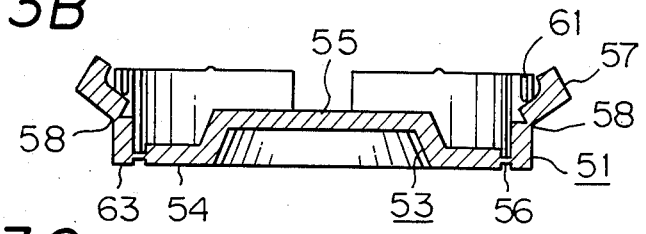
FIG. 3B is a sectional view of the rotating mechanism of FIG. 3A before attachment.
Figure 3C:
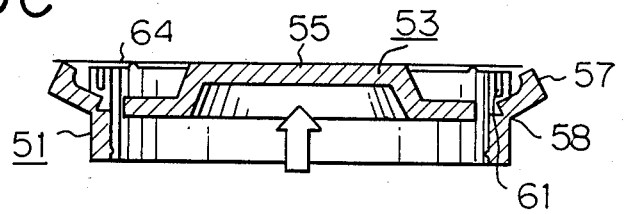
FIG. 3C is a sectional view of the rotating mechanism of FIG. 3C showing the attachment member 53 when separated from the base member 51.
Figure 3D:
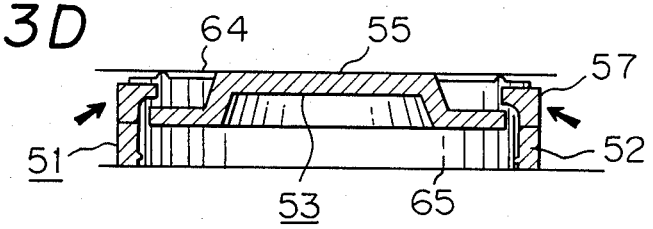
FIG. 3D is a sectional view of the rotating mechanism after attachment.

According to this embodiment of the present invention, swingable stoppers 57 in the form of a hook are formed at plural portions of the circular side wall 52 for preventing the base member 51 from becoming detached from the attachment member 53 after the base member 51 is separated from the attachment member 34 by breaking the connecting portions 56. For this reason, the top edge portions 59 of the stoppers 57 in a position shown in FIG. 3D must be inwardly projected to such an extent that the base member 51 is not detached from the attachment member 53 after the attachment member 54 is attached to the bottom of the container. However, the structure and the size of the stoppers 57 should be such that the integrally molded rotating mechanism can be readily removed from a mold after molding. To this end, the stoppers 57 are swingable by hinges 58 so that the stoppers 38 are outwardly hinged, as shown in FIGS. 3A, 3B, 3C, and 3E. Thus, the molded rotating mechanism 50 can be readily removed from a mold after molding. However, once the molded rotating mechanism 50 is attached to the bottom of the container, the stoppers 57 are fixedly set in a position as shown in FIG. 3D. This fixing can be effected by, for example, a combination of the raised portions 60 and the fitting recesses 61. The hinge portions 58 can be formed at the bottom of the stoppers 57 in the form of grooves.

Figure 3E:
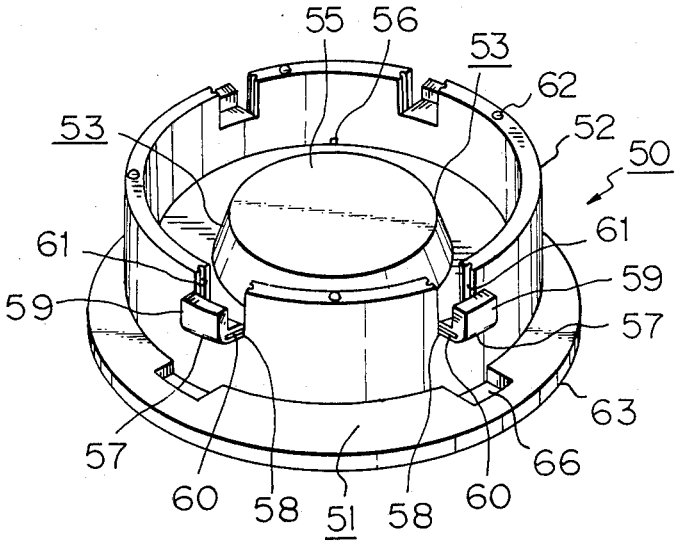
FIG. 3E is a perspective view of a modified embodiment of the rotating mechanism of FIG. 3A.

According to the modified embodiment of this embodiment shown in FIG. 3E, openings 66 are opened in the base plate 63, so that the molded rotating mechanism can be removed from the mold.

Although there is no special limitation to the number of the stoppers 57, a plurality of the stoppers 57 must be provided, preferably 3 or more.

Furthermore, according to the present invention, plural projections, preferably 3 or more of projections 62 are provided on the top end surface of the circular side wall 52 to facilitate the sliding action of the bottom of the container when the container is rotated.

The rotating mechanism 50 of the present invention is advantageously attached to, for example, the bottom 92 (see FIG. 5B) of a beer container 90 as shown in FIGS. 5A and 5B. When the rotating mechanism is attached to the bottom 92 of the containers 90, the container 90 can be freely rotated so that the handle 91 can be readily grasped.

The rotating mechanism 50 of the present invention is attached to the bottom of the container 64 as shown in FIG. 3D. The attachment plate 53 is attached or bonded to the bottom of the container by means of, for example, a hot melt using any conventional adhesive. The separation of the attachment member 53 from the base member 51 can be readily effected manually either before or after the attachment of the rotating mechanism to the bottom of the container. Thus, the base member 51 is placed on, for example, the surface of a table 65 and the container can be readily and freely rotated with very little force.

Figure 4A:
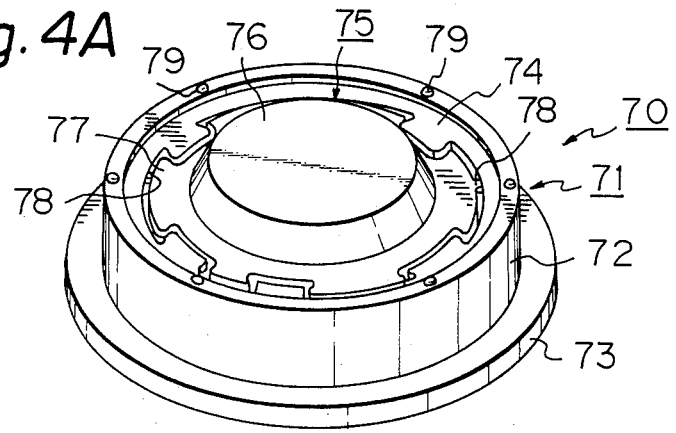
FIG. 4A is a perspective view of a fourth embodiment of the rotating mechanism according to the present invention.
Figure 4B:
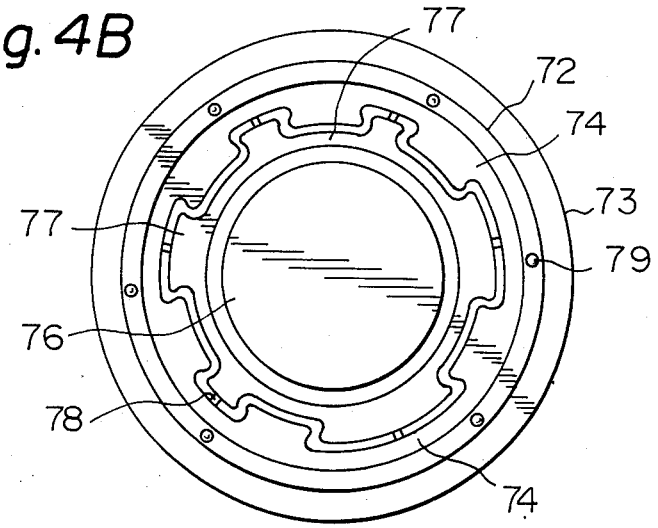
FIG. 4B is a plan view of the rotating mechanism of FIG. 4A before attachment.
Figure 4C:
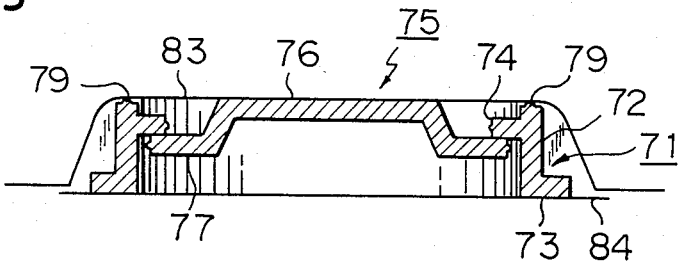
FIG. 4C is a sectional view of the rotating mechanism of FIG. 4A after attachment.
Figure 4D:
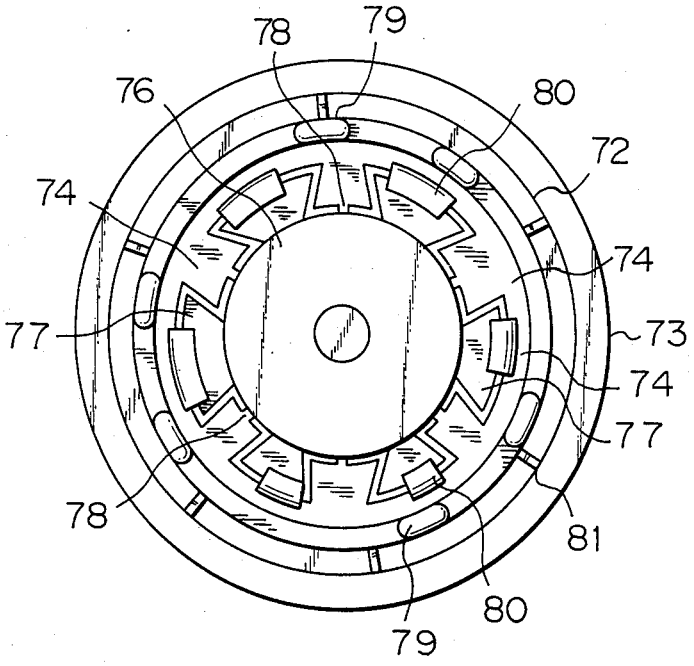
FIG. 4D is a plan view of a modified embodiment of the rotating mechanism of FIG. 4A.

The fourth preferred embodiment of the rotating mechanism according to the present invention is schematically illustrated in FIGS. 4A to 4C.

As is clear from these drawings, a rotating mechanism 70 comprises a base member 71 and an attachment member 75. These members are molded from the same material in one operation and are connected to each other at connecting portions 78. The base member 71 is composed of a circular side wall 72 and a base plate 73. The attachment member 75 is composed of a peripheral support portion 77 and an attachment plate 76.

According to this embodiment, a rim 74 inwardly projected from the upper portion of the inside wall of the circular side wall 72 and the peripheral support portion 77 of the attachment member 75 are designed such that the base member 71 can be detached from the attachment member 75 only at the position as shown in FIGS. 4A and 4B. Thus, the rotating mechanism 70 can be removed from a mold after molding in the position as shown in FIG. 4B. However, after the base member 71 is separated from the attachment member 75, the possibility of the detachment of the base member 71 from the attachment member 75 is very rare since the rim 74 has an irregular inner contour with an axis asymmetrical shape and also since the peripheral support portion of the attachment member 77 has a periphery contour such that it is matched with the irregular inner contour of the rim with a small clearance (e.g., 0.5 to 1.5 mm).

There is no limitation to the shape of the contour of the rim 74, so long as it is an axis asymmetrical shape. The term "an axis asymmetrical shape" used herein means that the shape is not symmetrical against the rotating axis of the base member 71 and the attachment member 75 and that the attachment member 75 can be passing through the openings of the rim 74 of the base member 71 only at the position where the rotating mechanism 70 is integrally molded. Examples of the shape of the contour of the rim 74 are an equilateral triangle, a scalene triangle, a parallelogram, a trapezoid, and other scalene polygones, and minor modifications of those shapes. Furthermore, animal shapes such as panda and penguin and marks or crests can be used.

However, according to the modification of this embodiment shown in FIGS. 4D to 4I, fixed stoppers 80 in the form of a hook are provided at plural portions of the rim 74 of the base member 71. These stoppers prevent the base member 71 from becoming detached from the attachment member 75 after the base member 71 is separated from the attachment member 75 by breaking the connecting portions 78. The top edge portions of the stoppers 80 in a position shown in FIG. 4F must be inwardly projected to such an extent that the base member 71 is not detached from the attachment member 75 after the attachment member 75 is attached to the bottom of the container. However, the structure and the size of the stoppers 80 should be such that the elasticity of the stoppers 80 enables the integrally molded rotating mechanism to be readily removed from a mold after molding. The size of the stoppers 80 can be readily designed by those skilled in the art. Although there is no special limitation to the number of the stoppers 80, a plurality, preferably 3 or more, of the stoppers 80 must be provided.

According to further modification of this embodiment as shown in FIGS. 4J to 4M, the fixed stoppers 87 and the raised portions 89 are provided at plural portions on the rim 74 of the base member 71. These raised portions 89 prevent the base member 71 from becoming detached from the attachment member 75 by stopping the rotation of the attachment member 75 even when the attachment member 75 is passing through the openings of the rim 74 of the base number 71, after the attachment number 75 is separated from the base member 71 by breaking the connecting portions 78. Although there is no special limitation to the number of the raised portions 89, a plurality, preferably 3 or more, of the raised portions 89 must be provided.

Figure 4E:
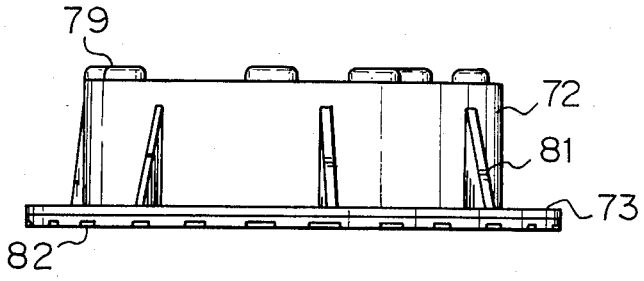
FIG. 4E is a front view of the rotating mechanism of FIG. 4D.
Figure 4F:
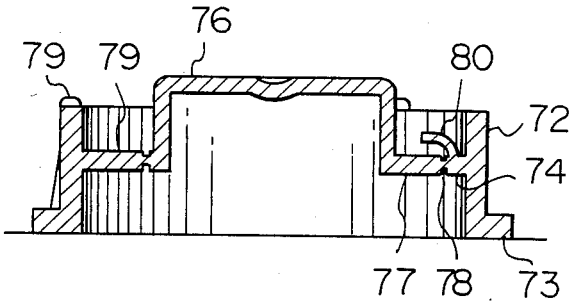
FIG. 4F is a sectional view of the rotating mechanism of FIG. 4D.
Figure 4G:
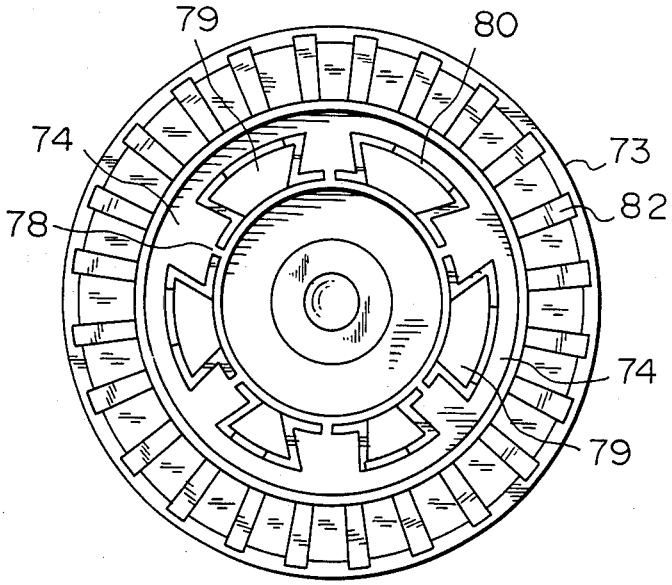
FIG. 4G is a bottom view of the rotating mechanism of FIG. 4D.
Figure 4H:
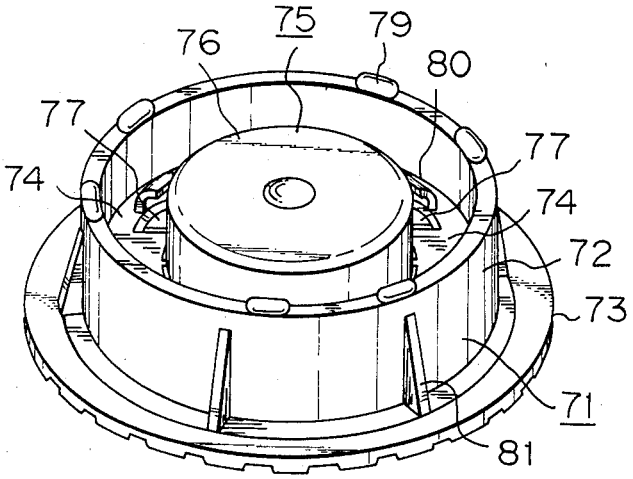
FIG. 4H is a perspective view of the rotating mechanism of FIG. 4D.
Figure 4I:
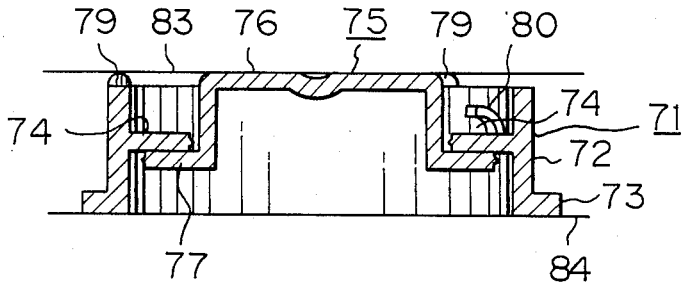
FIG. 4I is a sectional view of the rotating mechanism of FIG. 4D after attachment.
Figure 4J:
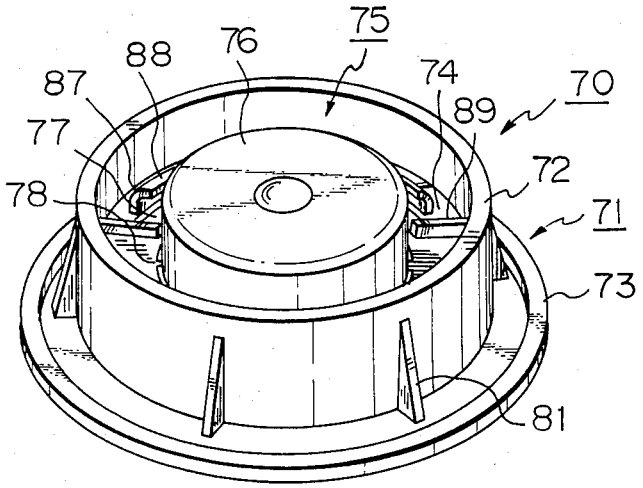
FIG. 4J is a perspective view of a further modified embodiment of the rotating mechanism of FIG. 4A according to the present invention.
Figure 4K:
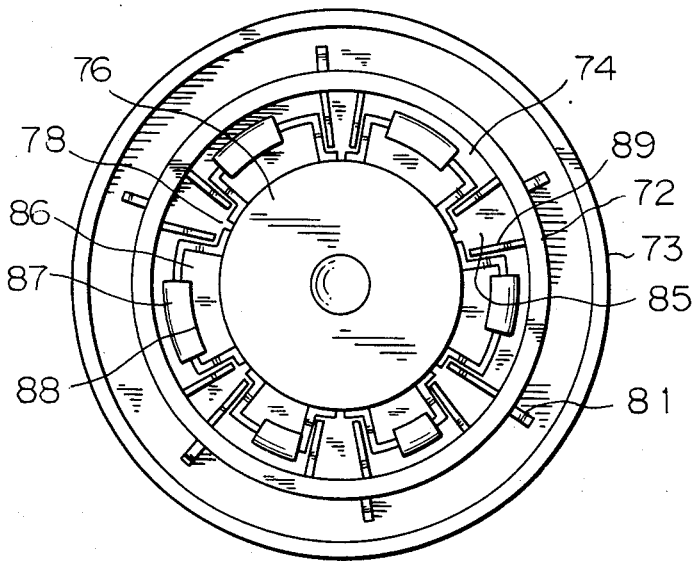
FIG. 4K is a plan view of the rotating mechanism of FIG. 4J before attachment.
Figure 4L:
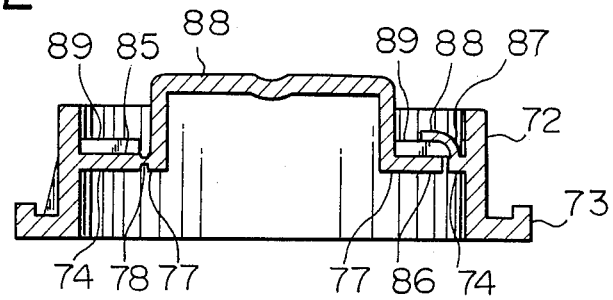
FIG. 4L is a sectional view of the rotating mechanism of FIG. 4J before attachment.
Figure 4M:
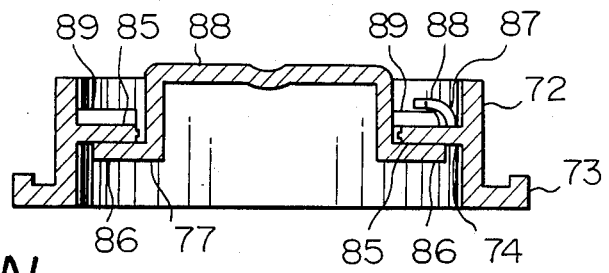
FIG. 4M is a sectional view of the rotating mechanism of FIG. 4J showing the attachment member 74 when separated from the base member 71 and the position of the attachment member 74 when rotated.

According to the preferred embodiment of the present invention, the reinforcing ribs 81 can be provided at the outer wall of the peripheral wall 72 as shown in, for example, FIG. 4E or 4J. These reinforcing ribs 81 serve as means for increasing the stiffness of the peripheral wall 72 to support the weight of the container containing, for example, beer.

According to another preferred embodiment of the present invention, the sliding preventing grooves 82 are provided at the back surface of the base plate 73 for preventing the slipping of the container with the rotating mechanism as shown in FIGS. 4E and 4G.

Furthermore, according to the present invention, plural projections, preferably 3 or more of the projections 79, are provided on the top end surface of the circular side wall 72 to facilitate the sliding action of the bottom of the container when the container is rotated.

The rotating mechanism 70 of the present invention is advantageously attached to, for example, the bottom 92 (see FIG. 5B) of a beer container 90 as shown in FIGS. 5A and 5B. When the rotating mechanism is attached to the bottom 92 of the containers 90, the container 90 can be freely rotated so that a handle 91 can be readily grasped.

Figure 4N:
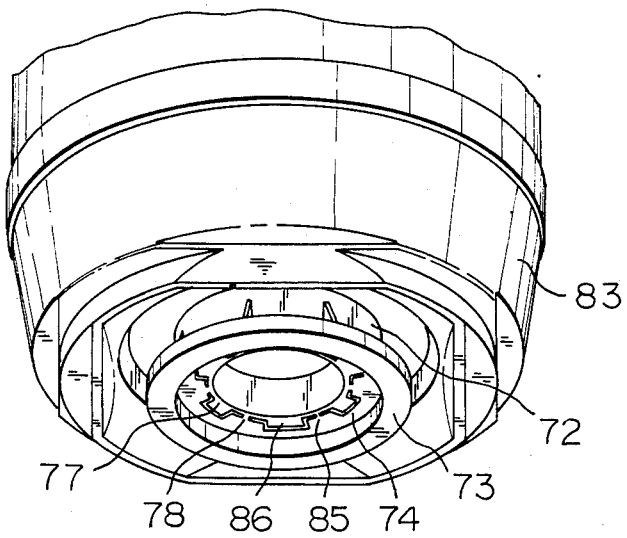
FIG. 4N is a perspective bottom view of the rotating mechanism of FIG. 4J after attachment.

The rotating mechanism 70 of the present invention is attached to the bottom of the container 83 as shown in FIG. 4C, 4I or 4N. The attachment plate 76 is attached or bonded to the bottom of the container by means of, for example, a hot melt using any conventional adhesive. The separation of the attachment member 75 from the base member 71 can be readily effected manually either before or after the attachment of the rotating mechanism to the bottom of the container. Thus, the base member 71 is placed on, for example, the surface of a table 84 and the container can be readily and freely rotated with very little force.

As mentioned hereinabove, according to the present invention, the container placed on, for example, a table can be readily and freely rotated with a very simple and inexpensive means when the present rotating mechanism is attached to the bottom of the container, as the rotating mechanisms according to the present invention having the above-mentioned structures can be integrally molded in one mold and can be easily attached to the bottom of the container without necessitating the modification of the bottom of existing containers.

Although it is explained hereinabove that the rotating mechanisms of the present invention are attached to the bottom of the middle-sized beer container, it should be noted that the present rotating mechanisms are applicable to any container having a bottom with a surface to which the attachment plate of the attachment member can be attached and also with a surface which can be in contact with and slide on the top surface of the base member.

I claim:

1. A rotating mechanism attachable to the bottom of a container comprising:

(A) a base member composed of (i) a circular side wall provided with means for preventing the base member from becoming detached from an attachment member after the attachment thereof to the bottom of a container and (ii) a base plate provided at the bottom portion of the circular side wall; and (B) the attachment member composed of (i) a peripheral support portion having an outer diameter smaller than an inner diameter of the circular side wall and (ii) an attachment plate, the bottom portion of the circular side wall of the base member being connected to the peripheral support portion at connecting portions thereof in such a manner that both portions are readily mechanically separable from each other, (C) wherein said means for preventing the detachment of the base member comprises (i) a rim having an irregular inner contour with an axis asymmetrical shape and inwardly projected from the upper portion of the inside wall of the circular side wall and (ii) the peripheral support portion of the attachment member having a periphery contour such that it is matched with the irregular inner contour of the rim with a small clearance.

2. A rotating mechanism as claimed in claim 1, wherein stoppers are provided at portions of the rim inwardly projected from the circular side wall so that the small clearance between the rim and the outer periphery of the peripheral support portion is covered to prevent the detachment of the base member from the attachment member even when the attachment member is passing through the openings of the rim of the base member, after the attachment thereof to the bottom of a container, said stoppers having sufficient elasticity so that the rotating mechanism can be removed from a mold.

3. A rotating mechanism as claimed in claim 2, wherein raised portions are provided on the rim of the peripheral side wall thereby preventing the rotation of the attachment member when the attachment member is passing through the openings of the rim of the base member, after the attachment member is separated from the base member by breaking the connecting portions.

4. A rotating mechanism as claimed in claim 1, wherein said base member is provided with projections capable of facilitating the rotation of the container at the top of the circular side wall.

5. A rotating mechanism as claimed in claim 1, wherein reinforcing ribs are provided at the outer wall of the peripheral side wall.

* * * * *